US005890439A

United States Patent [19]

McGunn

[11] Patent Number: 5,890,439

[45] Date of Patent: Apr. 6, 1999

[54] SAFE DEPOSIT BOX ASSEMBLY

[76] Inventor: Edward T. McGunn, 6520 N. Pontiac, Indian Head Park, Ill. 60525

[21] Appl. No.: 786,671

[22] Filed: Jan. 21, 1997

[51] Int. Cl.[6] ..... E05G 1/00

[52] U.S. Cl. ..... 109/47; 232/1 D; 232/4 D; 232/15; 232/43.2; 70/DIG. 63; 70/268; 109/56; 109/55; 109/46

[58] Field of Search ..... 70/267, 268, DIG. 63; 232/1 D, 15, 16, 31, 43.2; 109/45, 46, 47, 52, 55, 66, 56

[56] References Cited

U.S. PATENT DOCUMENTS

| | | | |
|---|---|---|---|
| 140,985 | 7/1873 | Winchell | 232/15 |
| 2,973,139 | 2/1961 | Leone et al. | 232/15 |
| 3,292,849 | 12/1966 | Ewing | 232/15 |
| 3,823,586 | 7/1974 | Melaneon | 70/268 |
| 4,186,977 | 2/1980 | Gilovich et al. | 232/15 |
| 4,452,390 | 6/1984 | West | 232/43.2 |
| 4,597,340 | 7/1986 | Huckle | 109/45 |
| 4,638,746 | 1/1987 | Ishigure | 232/15 |
| 4,714,029 | 12/1987 | Idegren | 109/45 |
| 5,129,330 | 7/1992 | McKay et al. | 232/15 |
| 5,161,736 | 11/1992 | Roccoberton et al. | 232/15 |
| 5,533,605 | 7/1996 | Mays et al. | 232/15 |
| 5,607,102 | 3/1997 | Walsh et al. | 232/15 |

FOREIGN PATENT DOCUMENTS

| | | | |
|---|---|---|---|
| 0091314 | 10/1983 | European Pat. Off. | 70/268 |
| 2117823 | 10/1983 | United Kingdom | 70/267 |
| 2135386 | 8/1984 | United Kingdom | 70/267 |

*Primary Examiner*—Darnell M. Bouchar
*Attorney, Agent, or Firm*—Brown, Martin, Haller & McClain, LLP

[57] ABSTRACT

An improved safe deposit assembly including an outer housing, a removable inner container, and one or more lock devices which may be in signal communication with a time-delay device for securing valuables within. To unlock and remove the inner container from the outer housing, a separate cover is slid in to a slot on the outer housing. The cover locks a lock before releasing a latch, and neither the lock or latch are accessible until the container is removed from the housing. But a first lock must be unlocked before the cover may be slid in. The first lock may be in signal communication with a time delay to device to thwart robbery attempts. As the cover is slid in it first becomes trapped by a spring lock on the inner container and then it releases a second spring bolt lock that both seals the inner container and releases it from the outer housing. The sealed inner container may only be opened by unlocking the lock device. This may be used in conjunction with a safe enclosure and/or a cash drawer with a selectively openable bottom portion.

15 Claims, 5 Drawing Sheets

SAFE DEPOSIT BOX ASSEMBLY

BACKGROUND OF THE INVENTION

1. Field of the Invention

The present invention relates generally to a safe deposit box for valuables including cash, and, more specifically, to such a safe deposit box including an inner security box that is selectively removable from an outer housing and that remains secure from intrusion until unlocked.

2. Description of the Related Art

It is well known to provide security boxes for protection of cash received in various environments including retail point of sale, vending and gaming machines, casino operations, and motels. The security boxes receive and hold cash, and then can be carried to a remote location where authorized personnel open the box and remove the cash. To prevent tampering and theft the boxes are sealed upon removal from their stationary cash-receiving positions.

For example, U.S. Pat. No. 5,129,330 to McKay et al., assigned to Sigma Game, Inc. shows a currency security box that may be employed in gaming machines, bill changers and other machines. An inner box that receives currency may be removed from its housing only after a four-sided, generally open box-shaped cover has been slid over the inner box, sealing access to the cash. The box-shaped cover includes a lock which must be opened to gain access to the money. The intent of the design is to allow the inner box to be transported to authorized persons who have means to unlock the cover, for removing the cash. However, since the lock mechanism for the inner box is easily accessible from the outside before it is removed from it's housing, a thief may use force to break the lock or other more sophisticated means to defeat the lock while it is still combined with its housing. This is a problem because a security box is typically unguarded while in its housing, on the other hand, armed guards may accompany delivery of such boxes to a safe location.

In addition, it is disadvantageous that the mechanism for releasing the inner box is simply the leading edge of the cover that pushes on latches coupling the inner box to the housing. Such a mechanism may be easily defeated by a moderately sophisticated thief, who simply has to wedge a thin object between the housing wall and the nearest inner box wall to release the latch, analogous to the way that simple latch type locks on doors can be opened by wedging a credit card between the door frame and the lock latch to trip the latch. Once the box is removed without the cover its contents are freely available.

Another security box is disclosed in U.S. Pat. No. 5,161,736 to Roccoberton et al., and it is for operation in conjunction with a currency stacker and validation apparatus. The security box includes an open top currency receptacle having a slide-way for receiving a cover adjacent the opening. Further disclosed are means for locking the cover over the receptacle. The disclosed device is designed to work with a compatible currency validation apparatus such as a Mars Electronic Model or a Dixie Narco Upstack Acceptor. To remove the lid, a service person slides a lid through a slot and over an opening on the security box. The lid includes a strike plate for tripping a latch on the housing to release the box. The box may be removed once the latch is tripped, but the lid is retained over the box's open top, preventing access to the cash by service personnel. Unfortunately, the disclosed release mechanism has a similar shortcoming as described above with reference to the McKay patent. First of all, the lock is readily accessible when the device is in operation so that a thief may use force to defeat it. Also the slideway is open so that the release mechanism may be easily tripped by inserting something thin enough to fit through the respective openings which has a strike plate to trip the latch. Once the latch is tripped the security box may be removed. The cash in the removed uncovered security box is freely available to anyone, including thieves.

Each of the above-discussed security boxes are vulnerable to more sophisticated thieves or robbers who might devise counterfeit box covers or lids that can easily and quickly be slid into place. Such counterfeits may be designed to be intentionally weak or have open portions providing access to cash. In fact such an arrangement might be particularly popular with an armed robber because it would allow him an opportunity to rebuff an attempt to place covers or lids offsite so that attendants would not be able to release the security boxes. Of course if the intended cover is available to the attendants, they may be forced to release the box and robbers may simply take the locked box in hopes of breaking into it later. To the owner of the goods, there is little satisfaction in knowing that the box may present a formidable challenge to open once it and its valuables are stolen. Thus, it is a disadvantage of known security boxes, including the ones described above, that they can be quickly stolen.

One solution proposed is simply placing a security box inside of a combination safe, as described in U.S. Pat. No. 5,427,036 to Fee et al. However, once the safe is opened the box is readily available. Not providing the combination at the site is effective for preventing theft, but if knowledge of the combination is so restricted that normal management is unduly burdened, then the inconvenience may seriously weaken the benefit. For example, it is common at retail operations to count cash for each cashier and compare this to some accounting record for accurate accounting and to prevent short changes, etc. Thus, it would be an advantage to prevent quick theft without unduly burdening cash management activities.

Other security boxes in the prior art include one described in U.S. Pat. No. 4,186,977 to Gilovich et al. that includes a self-locking depository container. Feed means drive currency or an envelope containing valuable documents into a portable depositor. The Gilovich device includes a sliding door which is moved into an open position by insertion of the portable depository. The Gilovich device includes many moving parts which may make it uneconomical in terms of manufacturing and maintenance and repairs.

There are other security devices known that work with cash handling apparatus, such as currency validators including U.S. Pat. No. 4,638,746 to Ishigure, which discloses a device which opens and closes a cash container. A shutter opens only when the removable cash box is attached to a cash handling apparatus. Other such devices include U.S. Pat. Nos. 5,533,605 to Mays et al. and 5,209,335 to Shuren et al., that provide general background for prior art security boxes that work with currency stacker devices and include means for automatic cover closure when the security box is removed. However, all three are considerably complex, and therefor economically disadvantageous, and none overcome the exposures to thieves and robbers discussed above in reference to the McKay and Roccoberton devices.

Additionally the art is relatively devoid of solutions for safekeeping of valuables other than cash. Most are designed to cooperate with currency validators, and while there is a need for such boxes, it would be an advantage to provide a simple security box that could work with a currency validator, but could also receive cash directly from a cash drawer, or receive other valuables, including, for example, jewelry or valuable papers. It would further be an advancement in the art to provide a simple low cost security box that could work as described above and which was not vulnerable to being easily stolen by thieves or quickly stolen by robbers.

SUMMARY OF THE INVENTION

To overcome the limitations of the prior art discussed above, and in view of other limitations which will become apparent upon reading the detailed description below, this invention provides a safe deposit assembly including an outer housing, an inner security container having an opening for accepting valuables, including cash or other types of valuables, such as jewelry or important papers, into a receptacle, and a cover for both releasing the inner container from the outer housing, and covering it to prevent access to the valuables in the receptacle. A lock, that is inaccessible when the inner container is in the outer housing is activated by the cover, securing the cover to the container. Once the lock is locked, then a latch is released by the plate, so that the inner container can be removed. The valuables may only be removed when the lock is unlocked, and the lock may not be reached until the container is removed.

In an optional embodiment, a second lock blocks entry of the cover so that the box cannot be removed without first unlocking it. This second lock prevents unauthorized attempts to slide counterfeit plates or other devices toward the lock and latch to falsely simulate the plate. Thus, adding to the security of the device, and in particular, assuring that the container can not be removed by unauthorized persons.

In other alternative embodiments, the second lock may include a time-delay device and/or the housing and inner box may both be enclosed in a locked safe. The locked safe may also include another time-delay device. In still another alternative embodiment, the housing and inner box may work in a cooperative fashion with a cash drawer, with or without the locked safe enclosure.

BRIEF DESCRIPTION OF THE DRAWINGS

For a more complete understanding of the present invention, reference is now made to the following detailed description of the embodiments illustrated in the accompanying drawings in which identical numbers in various views represent the same or similar elements, and wherein.

DESCRIPTION OF PREFERRED EMBODIMENTS

Figure 1:
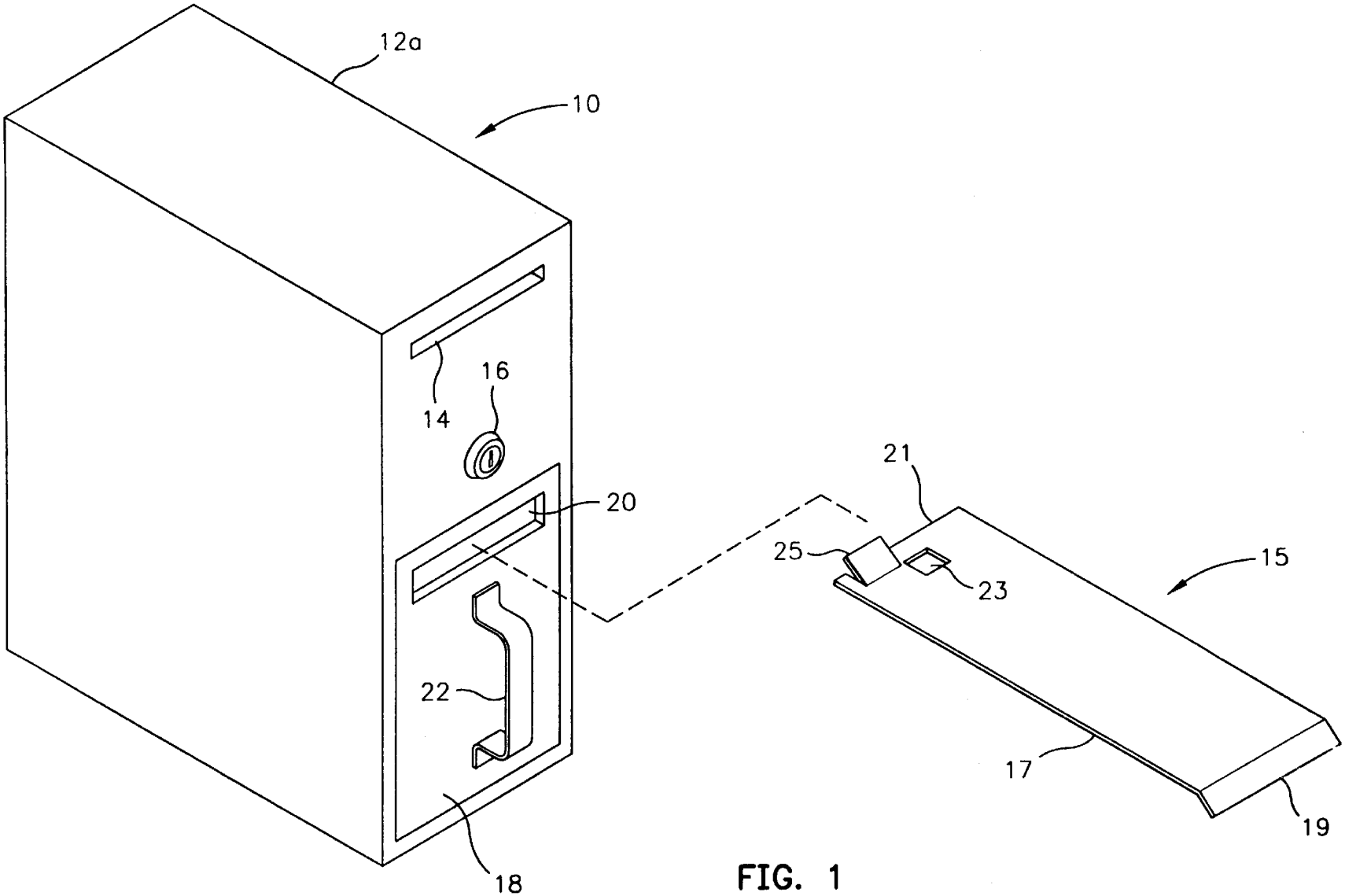
FIG. 1 is an exploded perspective view of an assembly embodying the present invention including a housing, and an inner security container secured thereto for receiving valuables.
Figure 3:
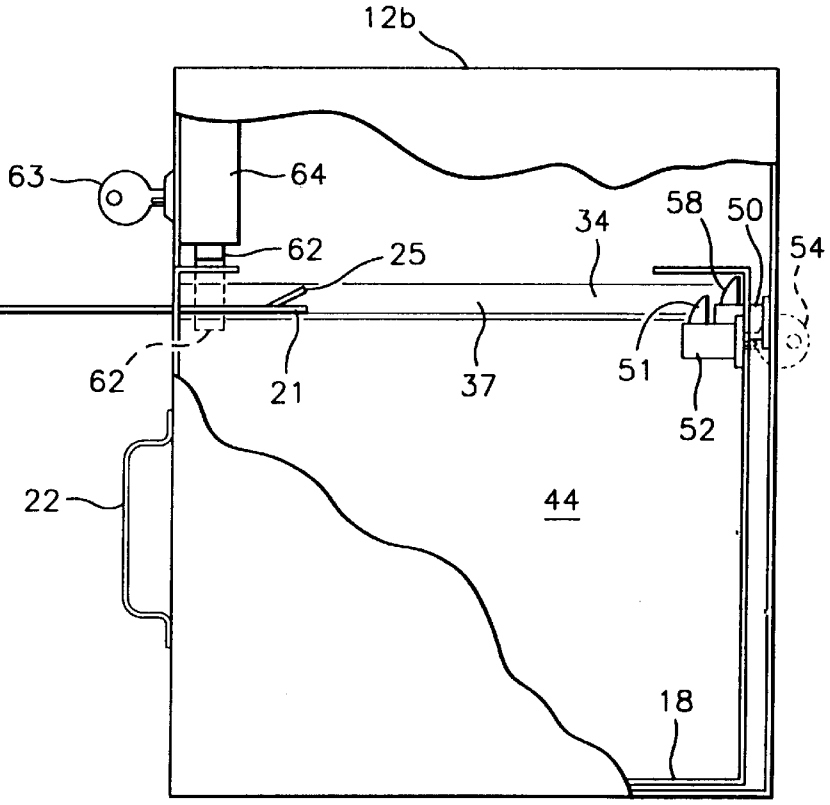
FIG. 3 is a partial cut away of the assembly shown in FIG. 1 demonstrating operation of the inner security container with the assembly.

FIG. 1 shows the safe deposit assembly 10 which is one embodiment of the present invention. It includes an outer housing 12*a* that has a port 14 for receiving valuables. Regarding nomenclature, throughout this specification almost identical housings are denoted as 12*a,* 12*b,* 12*c,* and 12*d.* Valuables may be cash, coins, jewelry, or anything of value that can fit through the opening. Of course the opening may be sized in accordance with expectations for size of valuables to be received. Referring to FIGS. 1 and 3, wherein FIG. 3 is a partially cut away view of assembly 10, an inner security container 18 is mounted in the housing for receiving valuables dropped into port 14. The valuables free fall or drop into a receptacle 44 through the inner container's open top 34 (best seen in FIG. 4). Preferably the inner container and outer assemblies are made of sheet metal, such as steel. The inner container has an access port 20 at one end to allow entry of cover 15 into a slide passage 37. Preferably cover 15 is composed of a strong metal such as steel and is an elongated plate-shaped. A user may conveniently use handle 19 to guide the cover through the access port 20 and into the passage 37. The slide passage is disposed between the end nearest the slot and a second opposite end on the other side of the inner container.

It is an advantage of this invention that the access port may be selectively blocked by a lock 64 extending a lock bar 62 to block access to the slide passage (extended position of lock bar 62 shown in phantom). The lock 64 may be locked or unlocked with key 63. Of course key 63 is only installed at a time when the locked or unlocked state of lock 64 is to be changed. Preferably, lock 64 is a simple conventional snap-bolt type lock. The lock 64 must be unlocked before the cover can be placed in the slot, and slid down the passageway. This is because a latch 50 having a latching member 58 joins the inner container to the outer housing, but the cover includes an activation member 25 disposed near the end of the cover that activates the latching member 58 when it reaches the end of the slide passageway. However, because of the relative placement of the latch and lock, the latch 50 cannot be activated until the lock 52 is locked by the cover's edge 21 pressing down member 51 which is then secured within opening 23 (FIG. 1). Preferably, latch 50 and lock 52 are conventional spring-bolt locks. Thus, the inner container 18 cannot be removed until the cover is locked over the opening 34. Later lock 52 can be unlocked by inserting key 54 (shown in phantom) in the lock. However, while the container is in the housing both the lock and latch are inaccessible, which is a significant advantage over the relevant prior art.

Preferably, the lock 52 is disposed relative to a longitudinal line parallel to the slide passage between the latch 50 and the end of the container having the access port 20. It is also preferable to include the latch and lock as part of the inner container, but either or both could be attached to the outer housing.

An additional advantage of this invention is that when the path 37 is blocked the cover cannot release the latch. This adds further protection to prevent unauthorized persons from using the slide passage to activate the latching mechanism and steal the inner container. Moreover, lock 64 passes lock bar 62 through aperture 45 (FIG. 4) to further secure the inner container to the housing, providing an additional security advantage. Preferably, lock 64 is attached to the outer housing, but this lock could also be attached to the inner container or even to the container itself.

If the lock 64 is placed in an open position, bar 62 does not block the passage 37, and the cover releases the inner container 18 from outer housing 12*a*. At this point, an operator may use handle 22 to remove the inner container from the outer housing. The cover also causes a lock 52 to move locking member 51 to capture the cover through the plate's opening 23. Thus, the cover is locked firmly over opening 34 of container 18, preventing access to valuables in receptacle 44 until lock 52 is unlocked. The inner container's permanently attached plate 53 (FIG. 4) prevents access to the lock member housing when the container is removed from the housing. The lock may be unlocked by key 54, which is preferably kept away from the inner container until it is ready to be unlocked and opened by an authorized person (usually at another location). Of course, any form of locking mechanism, including digital locks, combination locks, or other type of lock, well known to those skilled in the art, will work for any of the locks described above as long as they interact correctly with the plate. Of course, the same is true for lock 64, which may be any type of lock, including the types described above.

Figure 4:
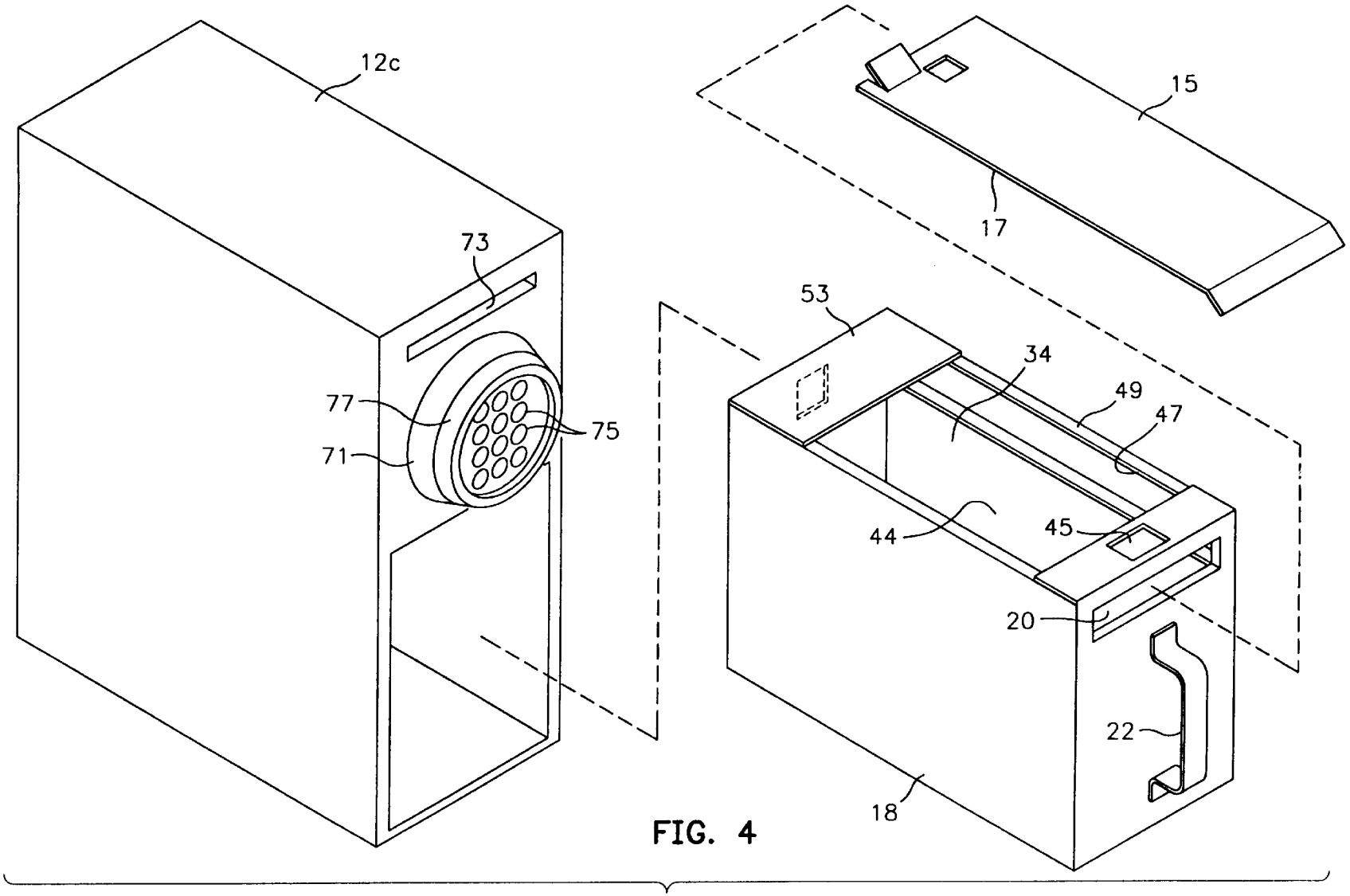
FIG. 4 is an exploded perspective view of another alternative embodiment of an assembly embodying the present invention, including the inner security container of FIG. 1 and a time-delay lock.

Referring to FIG. 4, the slide passage of the inner container includes first and second slide rails 47 disposed respectively on first and second side edges 49 for receiving therein the cover edges 17 such that it is nestled between the slide rails over the receptacle opening 34.

Figure 2:
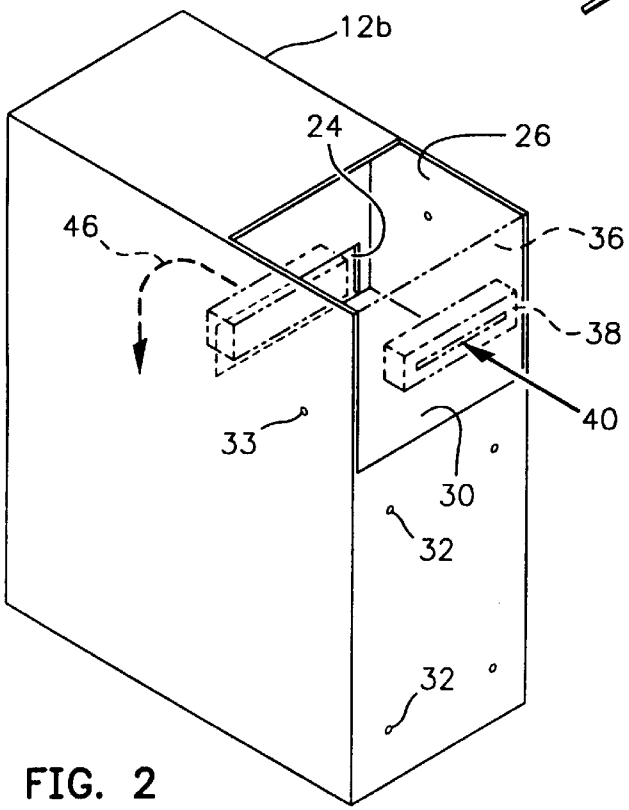
FIG. 2 is a perspective view of an alternative embodiment of an assembly embodying the present invention, including the inner security container of FIG. 1, and an adaptor portion for receiving a currency validator.

FIG. 2 shows an alternative embodiment of the safe deposit assembly. For simplicity only outer housing 12*b* is shown including an adapter port 26 for coupling thereto a deposit control device 36 (shown in phantom), such as a well-known currency validator, which may be any conventional validator made by vendors, such as Mars. Apertures 33 for securing a validation device are shown as examples of attachment means. Bills enter validator 36 at entry slot 38, traveling in direction 40 and through the housing's valuables receiving port 24, falling downward in direction 46 into receptacle 44 of the inner security container 18 (not shown in this view). A partition 30 seals the container to prevent access when the currency validator is being serviced. Apertures 32 are exemplary through-holes for mounting with fasteners (not shown) to a safe enclosure, described below with reference to FIGS. 5 and 6.

FIG. 4 shows another alternative embodiment of the assembly, including outer housing 12*c*, with a digital combination lock 71, with input pad keys 75 for inputting a combination code to lock/unlock the outer housing. Inner security container 18 operates in the same fashion with outer housing 12*c* as described above with reference to outer housing 12*a* (FIG. 1). Valuables are dropped through valuables receiving port 73 into receptacle 44 through opening 34 of the inner container. Cover 15 operates in the same fashion with latch lock 50, as described above (lock 50 not shown in this view). Lock 71 blocks entry of cover 15 into the passageway of container 18 so that it cannot be removed except by authorized personnel. Preferably, lock 71 is in signal communication with a time-delay device (not shown) disposed within housing 77. A conventional time-delay device is preferable. Thus, for the first time this invention uses such a lock in communication with a time-delay device to prevent access to a security container's open area, to prevent unauthorized access to the security container in an economical manner.

In operation, an operator preferably enters a code, that activates a timer. Until the timer's time criterion is satisfied, the lock will prevent passage of the plate, so that the inner container can't be removed, providing a strong deterrent to robbery.

Figure 5:
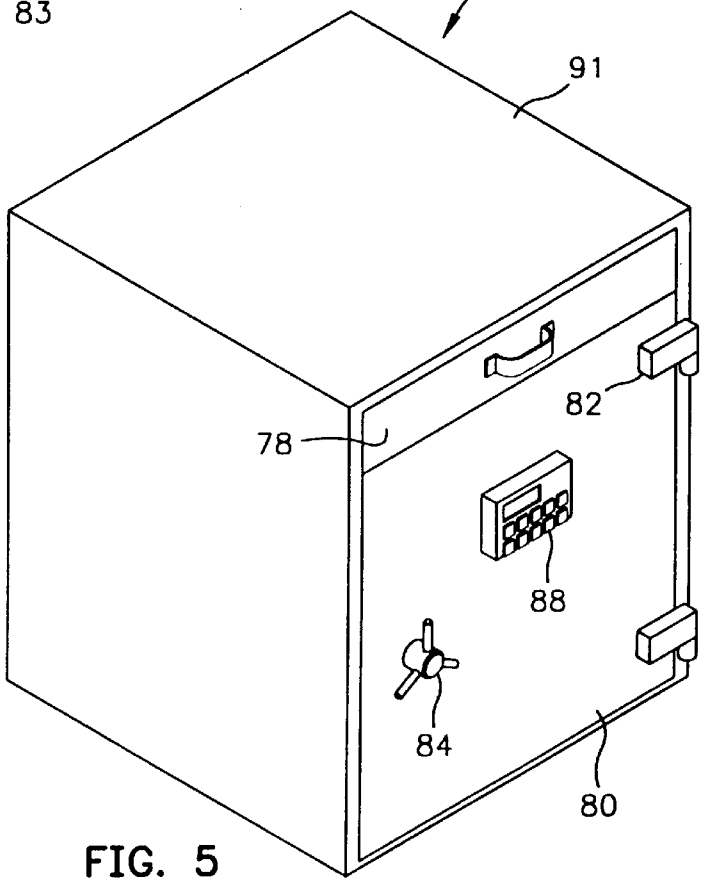
FIG. 5 is a perspective view of still another alternative embodiment of the present invention, including a valuables depositing drawer, and a safe enclosure for the inner security container of FIG. 1 and a time-delay lock.
Figure 6:
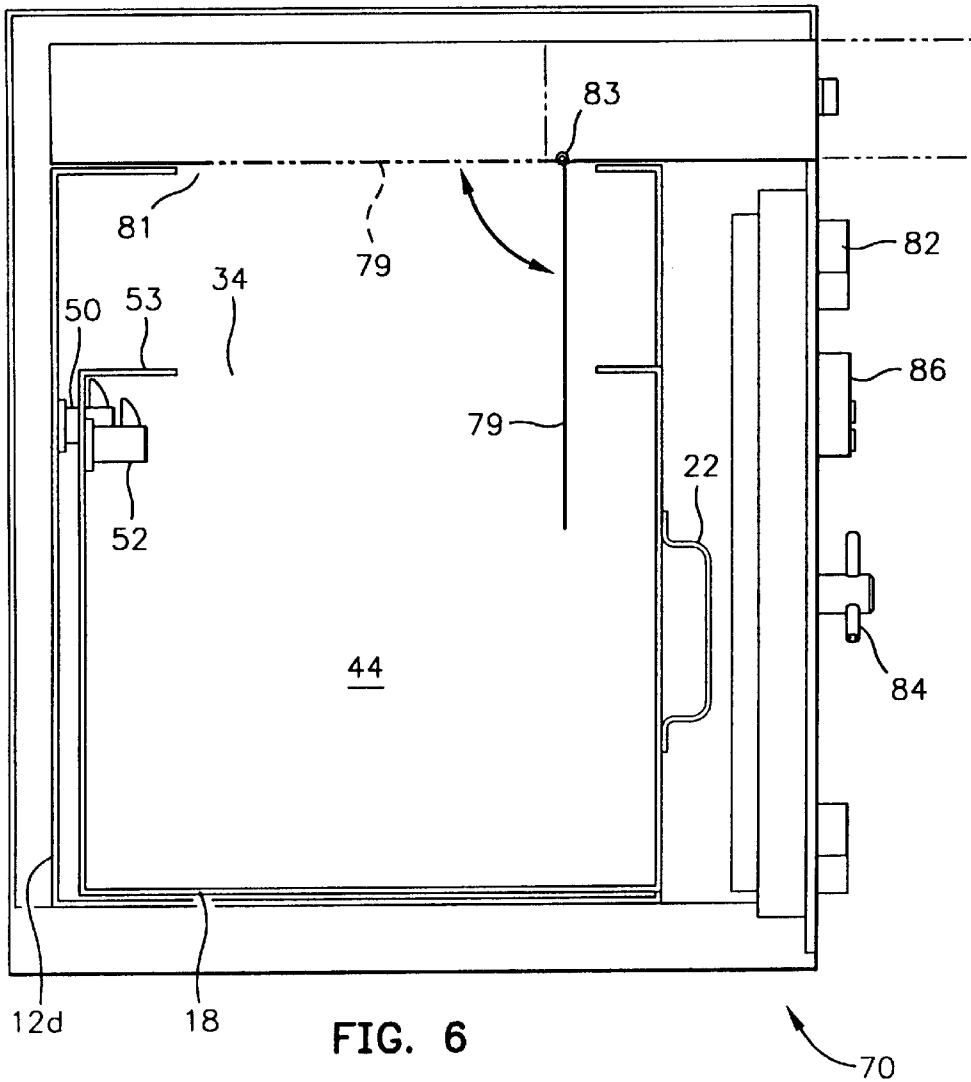
FIG. 6 is a side view of the assembly of FIG. 5 showing operation of the valuables depositing drawer.
Figure 7:
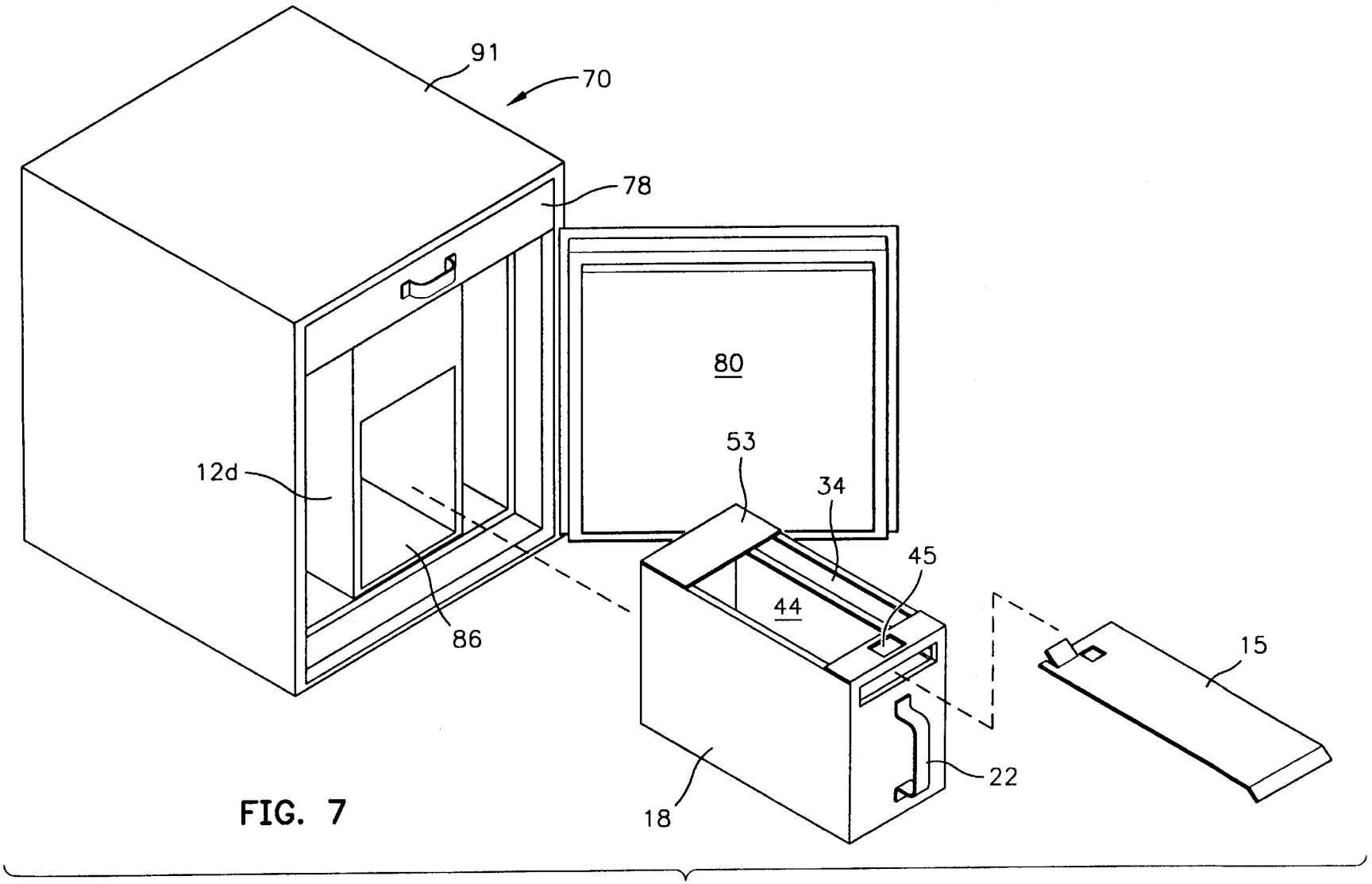
FIG. 7 is an exploded perspective of the assembly of FIGS. 5 and 6.

FIGS. 5, 6, and 7 each show another alternative embodiment of the safe deposit assembly of the present invention. FIG. 5 shows a safe enclosure assembly 70 that includes safe structure 91 having lockable door 80 secured by locking mechanism 88 and hinge-bolts 82 that safely enclose inner security container 18 within. A drawer 78 is positioned near the top of the safe enclosure. Valuables may be placed in the drawer for placement into receptacle 44. Referring to FIG. 6, The drawer has a selectively openable panel 79, that is opened by pushing the drawer in place above the housing 12*d* and inner container 18, causing hinge 83 to drop panel 79 to release the valuables contained in the drawer. In this embodiment, the housing's valuables receiving port 81 is vertically aligned with opening 34 of the inner container so that valuables fall into the receptacle 44 of container 18.

FIG. 7 shows door 80, opened by the turning of handle 84 (after unlocking), and in a partially exploded view also shows outer housing 12*d*, including a cavity 86 for receiving therein inner security container 18. Of course such a cavity is preferably provided in each embodiment of the outer housing (12*a–d*). Cover 15 is adapted to interact with locking and latching mechanisms identical to those described with reference to FIGS. 1 and 3 to lock the cover to the inner container top when it is unlatched from outer housing 12*d*. Although not shown, a time-delay or other type of lock can be employed to interact with the outer housing to prevent passage of the cover 15 in the passageway, identically as described above with reference to FIGS. 1, 3, and 4. It is also preferable to employ a time-delay device with lock 86, such that a code must be entered on keys 88 (FIG. 5), activating a timer, so that the safe cannot be opened until a certain time has passed to help deter robberies.

It should be clear to those skilled in the art that the drawer may be used in combination with the outer housing and inner container without requiring the safe enclosure assembly, substantially as shown in FIG. 6, without the lock 86.

A safe deposit assembly that can cooperate with a bill validator or operate without one to receive many types of valuables, including coins, cash, and jewelry has been described and shown. The assembly has the advantage that it employs an inner security container that cannot be removed until a lock is unlocked allowing a cover to be slid in sealing its open top. The assembly may be combined with a safe enclosure and a valuables receiving/depositing drawer. Further, the invention combines the assembly with a time-delay lock to deter armed robbery. In view of these teachings, modifications may occur to those skilled in the art, that are clearly within the spirit and scope of the invention. Therefore this invention is only to be limited by the claims appended below and their equivalents.

What is claimed is:

1. A safe deposit assembly, comprising:

an outer housing having an internal cavity and a front opening, and a valuables receiving port spaced from said front opening;

an inner container removably mounted in the internal cavity, the inner container having an outer end forming a closure for said front opening when said container is mounted in said cavity, a top, an aperture in the top in communication with the valuables receiving port, an inner end spaced from said outer end inside said housing, and a valuables receiving chamber in communication with said aperture;

the outer end of the inner container having an access port for a cover;

a cover slidably movable through said access port towards said inner end of said inner container into an extended position completely covering said inner container aperture and retractable through said access port out of said container to uncover said aperture;

a first lock member adjacent the inner end of said inner container and spaced a predetermined distance from said valuables receiving port whereby said first lock member is inaccessible when said inner container is positioned within the outer housing, said first lock member releasably locking said cover in said extended position covering said inner container aperture;

a second lock member adjacent the inner end of said inner container and spaced to a predetermined distance from said valuables receiving port whereby said second lock member is inaccessible when said inner container is positioned in said outer housing, said second lock member releasably locking said inner container in said outer housing when said inner container is inserted in said housing;

said cover further comprising means for automatically releasing said second lock member when moved into said extended position;

said first lock member comprising means for automatically locking said cover in said extended position on release of said second lock member by said cover; and a third lock member for selectively blocking entry of the cover through the access port.

2. The assembly as claimed in claim 1, wherein the outer housing has a front wall in which said front opening and valuables receiving port are located, a rear wall, and a closed top, and the inner container has an inner wall positioned adjacent said rear wall when said inner container is mounted in said outer housing, said second and third lock members being positioned adjacent said inner and rear walls.

3. The assembly as claimed in claim 1, wherein the inner container has a slide passage aligned with said cover access port and extending over said aperture, and the cover being slidably engageable along said slide passage to cover said aperture in said extended position.

4. The assembly as claimed in claim 1, including a time delay device in signal communication with said third lock, and means for preventing unlocking of said first lock for a predetermined time period after said third lock is unlocked.

5. The assembly as claimed in claim 4, wherein the time delay device includes an input pad and the timer is activated by a code entered on said input pad.

6. The assembly as claimed in claim 3, wherein the cover comprises a metal plate.

7. The assembly as claimed in claim 1, wherein the first lock is attached to the inner container.

8. The assembly as claimed in claim 1, wherein the second lock is attached to the inner container.

9. The assembly as claimed in claim 1, wherein the outer housing is a substantially rectangular, box-shaped housing.

10. The assembly as claimed in claim 9, wherein the inner container is a substantially rectangular, box-shaped container of smaller dimensions than said housing.

11. The assembly as claimed in claim 1, wherein the inner container has a slide passage aligned with said cover access port and extending in a straight line along the top of said container over said aperture from said outer end towards said inner end, the first and second lock members being located along said straight line between said outer and inner ends and closer to said inner end, the second lock member being located closer to said inner end than said first lock member.

12. A safe deposit assembly, comprising:

an outer housing having an internal cavity and a front opening, and a valuables receiving port spaced from said front opening;

an inner container removably mounted in the internal cavity, the inner container having an outer end forming a closure for said front opening when said container is mounted in said cavity, a top, an aperture in the top in communication with the valuables receiving port, an inner end spaced from said outer end inside said housing, and a valuables receiving chamber in communication with said aperture;

the outer end of the inner container having an access port for a cover;

a cover slidably movable through said access port towards said inner end of said inner container into an extended position completely covering said inner container aperture and retractable through said access port out of said container to uncover said aperture;

a first lock member adjacent the inner end of said inner container and spaced a predetermined distance from said valuables receiving port whereby said first lock member is inaccessible when said inner container is positioned within the outer housing, said first lock member releasably locking said cover in said extended position covering said inner container aperture;

a second lock member adjacent the inner end of said inner container and spaced a predetermined distance from said valuables receiving port whereby said second lock member is inaccessible when said inner container is positioned in said outer housing, said second lock member releasably locking said inner container in said outer housing when said inner container is inserted in said housing;

said cover further comprising means for automatically releasing said second lock member when moved into said extended position;

said first lock member comprising means for automatically locking said cover in said extended position on release of said second lock member by said cover;

the inner container has a slide passage aligned with said cover access port and extending in a straight line along the top of said container over said aperture from said outer end towards said inner end, the first and second lock members being located along said straight line between said outer and inner ends and closer to said inner end, the second lock member being located closer to said inner end than said first lock member; and a third lock member located at the outer end of said container for selectively blocking entry of the cover through said access port.

13. The assembly as claimed in claim 12, wherein the top of the inner container has opposite first and second side edges, and the slide passage comprises first and second slide rails disposed respectively on the first and second side edges for slidably receiving the cover for movement into said extended position covering said aperture.

14. The assembly as claimed in claim 1, wherein the valuables receiving port is located above the front opening of said outer housing.

15. A safe deposit assembly, comprising:

an outer housing having an internal cavity and a front opening, and a valuables receiving port spaced from said front opening;

an inner container removably mounted in the internal cavity, the inner container having an outer end forming a closure for said front opening when said container is mounted in said cavity, a top, an aperture in the top in communication with the valuables receiving port, an inner end spaced from said outer end inside said housing, and a valuables receiving chamber in communication with said opening;

the outer end of the inner container having an access port for a cover;

a cover slidably movable through said access port towards said inner end of said inner container into an extended position completely covering said inner container aperture and retractable through said access port to uncover said aperture;

a first lock member for releasably locking said cover in said extended position covering said inner container aperture;

a second lock member for releasably locking said inner container in said outer housing when said inner container is inserted in said housing;

said cover further comprising means for automatically releasing said second lock member when moved into said extended position;

said first lock member comprising means for automatically locking said cover in said extended position on release of said second lock member by said cover; and a third lock member moveable between an extended position blocking entry of said cover through said access port and a retracted position allowing entry of said cover through said access port.

* * * * *